US006187094B1

(12) United States Patent
Mitsuhata et al.

(10) Patent No.: US 6,187,094 B1
(45) Date of Patent: Feb. 13, 2001

(54) DEVICE FOR MANUFACTURING PAPER FOR A THERMAL PRINTER

(75) Inventors: Takanori Mitsuhata; Toshiyuki Miyadera; Yasuo Hosoda; Fumio Matsui, all of Saitama-ken (JP)

(73) Assignee: Pioneer Electronic Corporation, Tokyo (JP)

( * ) Notice: Under 35 U.S.C. 154(b), the term of this patent shall be extended for 0 days.

(21) Appl. No.: 09/087,897

(22) Filed: Jun. 1, 1998

(30) Foreign Application Priority Data

May 30, 1997 (JP) ..... 9-142352

(51) Int. Cl.[7] ..... B05C 19/06

(52) U.S. Cl. ..... 118/60; 118/67; 118/68; 118/101; 118/249; 118/258; 118/DIG. 1

(58) Field of Search ..... 118/58, 60, 67, 118/68, 101, 249, 258, DIG. 1; 427/366, 370, 363

(56) References Cited

U.S. PATENT DOCUMENTS 4,617,231 * 10/1986 Hamada et al. ..... 427/366
4,814,819 * 3/1989 Torino et al. ..... 118/60
5,118,533 * 6/1992 Saji et al. ..... 427/366

* cited by examiner

*Primary Examiner*—Laura Edwards
(74) *Attorney, Agent, or Firm*—Arent Fox Kintner Plotkin & Kahn, PLLC

(57) ABSTRACT

A coating device is provided for coating particles of a particulate coating composite consisting of particles of resin and particles of an offset preventing agent having a higher melting point than that of the resin on a paper substrate. A pair of rollers are provided to be contacted with each other for fixing the particulate coating composite on one of surfaces of the paper substrate. The particulate coating composite and the paper substrate are heated from one of the rollers, The heating temperature is set to a value which is higher than a melting point of said resin and lower than a melting point of said offset preventing agent.

3 Claims, 3 Drawing Sheets

DEVICE FOR MANUFACTURING PAPER FOR A THERMAL PRINTER

BACKGROUND OF THE INVENTION

The present invention relates to a device and a method for manufacturing paper used in a thermal printer, and to particulate coating composite coated on the paper for forming an image forming layer.

The spread of personal computers and office computers has caused the wide use of printers capable of printing an image drawn with the computer in color. Thermal printers are usually used for printing out such a color image.

The thermal printer melts ink disposed on an ink sheet with a head thereof, and transfers the ink to a sheet of image forming paper, exclusively provided for thermal printers. The thermal printer roughly uses either of the two methods, namely, dye melting transfer system, and dye sublimating transfer system. In the dye melting transfer system, the ink sheet is heated and the melted ink is transferred to paper. Although the heat applied to each dot on the pint head makes it difficult to achieve a high resolution of the printed image, due to the technological improvement for miniaturization in recent years, such as the use of a head made of a single crystal silicon, the heat stabilization is improved, thereby easily controlling the heat of the head. Hence, a printer capable of printing a high resolution image is known.

On the other hand, the thermal printer using the dye sublimating transfer system heats an ink sheet having a sublimating dye as a main component. The vaporized dye is reacted with polyester resin which is formed on paper as the image forming layer, thereby transferring the image. By adjusting the heating quantity, the tone of each dot can be arbitrarily controlled. To the contrary, in the dye melting transfer system, the size and the darkness of the printed dot is constant.

The ink sheet for the dye melting transfer system comprises a coated film, for example, of polyethlene terephtalate formed on a carrier. On the other hand, the paper used in the dye sublimating transfer system is composed as follows. On a substrate comprising ordinary paper, synthetic paper or a sheet of synthetic resin, there is formed an image forming layer comprising a resin layer on which dye can be diffused or migrated, and a mold-releasing layer for preventing the sticking of the image forming layer on the ink sheet. The image forming layer has a coating composite of various resins including saturated polyester resin, and denatured silicone oil dissolved in organic solvent which is applied on the substrate such as synthetic paper and dried. The mold-releasing layer is formed by heating the image forming layer at a high temperature of more than 100° C., thereby allowing the silicone oil to bleed over the surface of the image forming layer, and thereafter cured.

The coating composite of the image forming layer used to be liquid. However, the use of a particulate composite has been considered and actually put into practice. Moreover, there has been known a technique of rendering the manufactured paper white as the ordinary paper by using a white particulate coating composite. The paper employing the particulate coating composite during the manufacture thereof can be used both for the dye sublimating transfer system and the dye melting transfer system.

FIG. 2 shows a device for manufacturing such a conventional paper. The device comprises a substrate feeder section 1, coating composite supply section 2, coating composite apply section 3, fixing section 4, and a discharge section 5. The substrate feeder section 1 comprises a pair of rollers and a carrier means. A paper substrate 7 (FIG. 3) on which the image forming layer is not yet formed, is delivered to the coating composite apply section 3 through the pair of rollers and the carrier means. The carrier means may be a well known device such as rollers and belts.

As shown in FIG. 3, the coating composite supply section 2 has an coating composite storage 8. Although not shown in the figure, the coating composite supply section 2 is further provided with a supply sleeve, blade, and a latent image forming device. In the case where paper is manufactured using a particulate coating composite as the coating composite, particulate coating composite 9 is stored in the coating composite storage 8.

The use of the particulate coating composite 9 is advantageous in that the manufacturing process can be simplified and the cost thereof is reduced. Namely, in the method where solution is applied on the substrate, various processes such as application, drying, and forming a mold-releasing layer are necessary. On the other hand, the process can be simplified when the particulate coating composite is used, thereby enabling to reduce the manufacturing cost.

In the device shown in the figures, the particulate coating composite 9 is white so that the manufactured paper is white as the ordinary paper. The particulate coating composite 9 is fed to the supply sleeve and the blade adjusts the thickness of the layer of the particulate coating composite 9 formed on the sleeve. The latent image forming device is provided to migrate the white particulate coating composite 9 from the developing sleeve to the substrate, and in the example shown in FIG. 3, comprises a charged drum 6 made of a photosensitive material. When a laser beam is radiated on the surface of the charged drum 6, a latent image represented by dots is formed.

As disclosed in Japanese Patent Application Laid Open 8-224970, The white particulate coating composite includes thermoplastic resin, white pigment as a colorant, and various waxes as an offset preventing agent. The offset preventing agent is included so as to improve the releasing characteristic between the thermoplastic resin and a roller which is provided in the fixing section 4. Namely, the melted offset preventing agent spread over the interface between the roller and the resin improves the releasing characteristic. Hence, the resin which ought to adhere on the substrate is prevented from adhering to the roller. The composition of the white particulate coating composite is explained in the above mentioned publication, so that further detailed description thereof is omitted.

As the charged drum 6 of the coating composite supply section 2 rotates, the white particulate coating composite 9 adhered on the surface thereof is carried to the transfer section. In the transfer section, a charge of opposite polarity to that of the white particulate coating composite 9 is applied to the substrate 7 at the underside thereof in FIG. 3, that is the opposite side of the substrate 7 to the side where the particulate coating composite is to be adhered. Hence, due to the electrostatic force, the white particulate coating composite is transferred to the substrate 7 in the form of dots. In the coating composite apply section 3, the white particulate coating composite 9 still adhering on the charged drum 6 at the transfer operation is removed by a well known cleaner section. The substrate feeder section 1, coating composite supply section 2 and the coating composite apply section 3 compose an application means in the description of the present invention.

The substrate 7 on which the white particulate coating composite 9 is adhered in the coating composite apply section 3 is fed to the fixing section 4 by a carrier means. As shown in FIGS. 4 and 5, the fixing section 4 comprises a fixing roller device 12 comprising a pair of rollers 10 and 11 for pressing and heating the substrate 7. When the substrate passes through a gap formed between the rollers 10 and 11, the white particulate coating composite 9 on the substrate 7 is pressed and heated so as to be melted, thereby forming an image forming layer 13 on the substrate 7. The substrate is then discharged from the manufacturing device through the discharge section 5.

In the fixing section, the offset preventing agent included in the white particulate coating composite is also melted when the substrate 7 is heated. Hence, the offset preventing agent is spread at the interface between the roller 10 and the resin in the particulate coating composite, thereby improving the releasing characteristic. As a result, the resin is prevented from adhering on the roller 10. Accordingly, the heat applied by the rollers is so controlled that the white particulate coating composite 9 including the offset preventing agent is melted.

Although there are other fixing means besides the one shown in FIGS. 4 and 5, the device shown in the figures, known as a heat roll fixing type employing heat and pressure, is most commonly used today. This is because the device provides good heat efficiency, improved safety, and stable fixing.

Referring to FIG. 5, describing the device more in detail, a heater 14 is provided inside the upper roller 10 so as to heat the composite 9 and the substrate 7. A halogen lamp may be used as the heater 14. The lower roller is urged by an elastic member (not shown) toward the upper roller, thereby pressing the substrate 7. By thus heating and pressing the substrate 7, the white particulate coating composite 9 is adhered on the substrate. In addition, a thermistor for controlling the fixing temperature, a thermoswitch 16, and a release pawl 17 for preventing the substrate 7 from winding on the roller 10 are provided.

The paper for the thermal printer is manufactured with such a device. In the last manufacturing process, the paper is cut into a sheet of a predetermined size. A predetermined number of sheets are packed and shipped. The paper is loaded in a thermal printer and a color image drawn with a computer is printed thereon.

In the thus manufactured paper, the offset preventing agent is melted with the resin comprising the white particulate coating composite. As explained above, the offset preventing agent is included so as to improve the releasing characteristic of the melted particulate coating composite from the roller 10. That is, since the melted offset preventing agent is spread in the area where the roller 10 contacts the white particulate coating composite, the releasing characteristic is improved. The offset preventing agent is heated by the heater described above, diffused across the surface of the substrate 7, and cooled after the heating, that is after passing between the rollers 10 and 11. Hence the offset preventing agent is spread over the entire surface of the substrate 7. However, such a completely spread offset preventing agent causes ink to be repelled when printing in the thermal printer, thereby forming blank portions in the image. This occurs in either types of printer employing the dye melting transfer system or the dye sublimating transfer system. Namely, in the dye melting transfer system, the bonding force between the ink and the image forming layer is weakened by the spread offset preventing agent. In the dye sublimating transfer system, the diffusion of the ink in the image forming layer is deteriorated by the offset preventing agent. Therefore, there is sought a technique for removing such a disadvantage without decreasing the releasing characteristic.

SUMMARY OF THE INVENTION

An object of the present invention is to provide a device and a method for manufacturing paper for a thermal printer wherein the disadvantage of the offset preventing agent is removed.

Another object is to provide a composition of a particulate coating composite used for manufacturing such paper.

According to the present invention, there is provided a device for manufacturing paper for a thermal printer comprising, coating means for coating particles of a particulate coating composite consisting of particles of resin and particles of an offset preventing agent having a higher melting point than that of the resin on a paper substrate, fixing means comprising a pair of rollers contacted with each other for fixing the particulate coating composite on one of surfaces of the paper substrate passing between the rollers, heating means provided in one of the rollers for heating the particulate coating composite and the paper substrate, heating temperature of the heating means being set to a value which is higher than a melting point of said resin and lower than a melting point of said offset preventing agent.

One of the rollers which is to be contacted with the particulate coating composite is made of material having a hardness higher than that of the other roller.

The heating means is provided in one of the rollers which is disposed on a side of the paper substrate on which the particulate coating composite is not coated.

The present invention further provides a method for manufacturing paper for a thermal printer, the steps comprising, coating particles of a particulate coating composite consisting of particles of resin and particles of an offset preventing agent having a higher melting point than that of the resin on a paper substrate, fixing the particulate coating composite on one of surfaces of the paper substrate by a pair of rollers contacted with each other, heating the particulate coating composite and the paper substrate from one of the rollers, heating the resin at a temperature higher than a melting point thereof and lower than a melting point of said offset preventing agent.

These and other objects and features of the present invention will become more apparent from the following detailed description with reference to the accompanying drawings.

DETAILED DESCRIPTION OF THE PREFERRED EMBODIMENT

Figure 1:
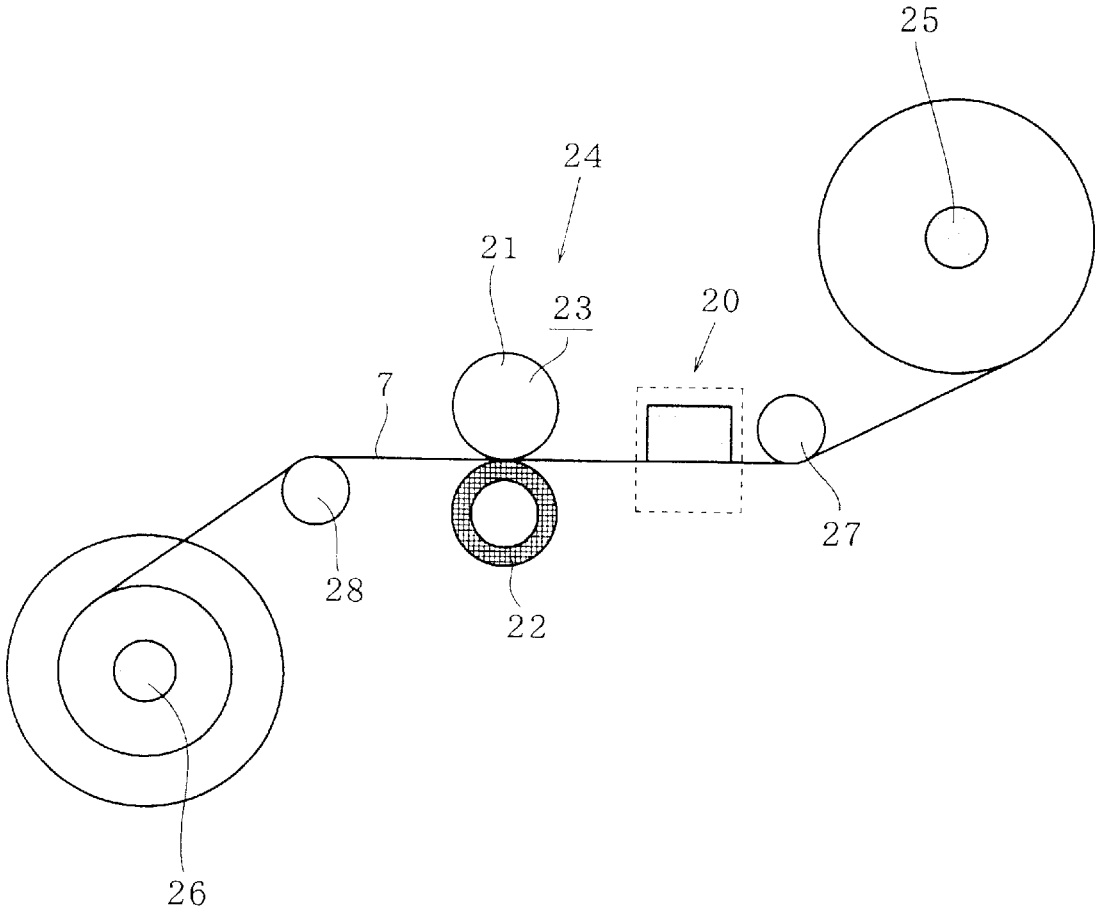
FIG. 1 is a schematic elevational view showing a main portion of a device for manufacturing paper for thermal printer in accordance with the present invention.
Figure 2:
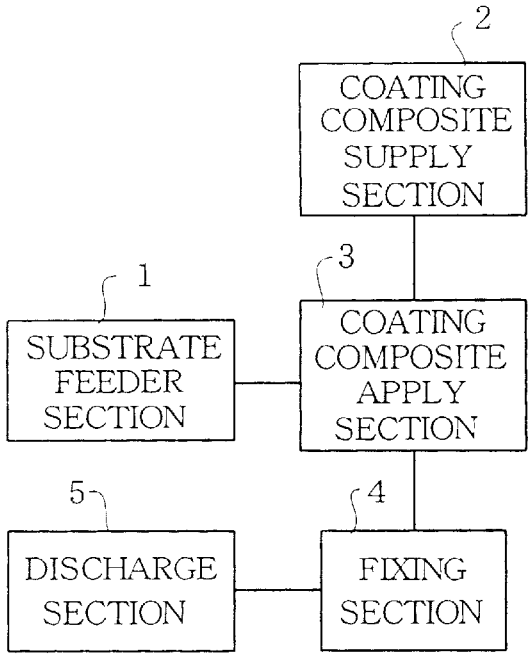
FIG.2 PRIOR ART
FIG. 2 is a block diagram explaining a construction of a conventional manufacturing device.
Figure 3:
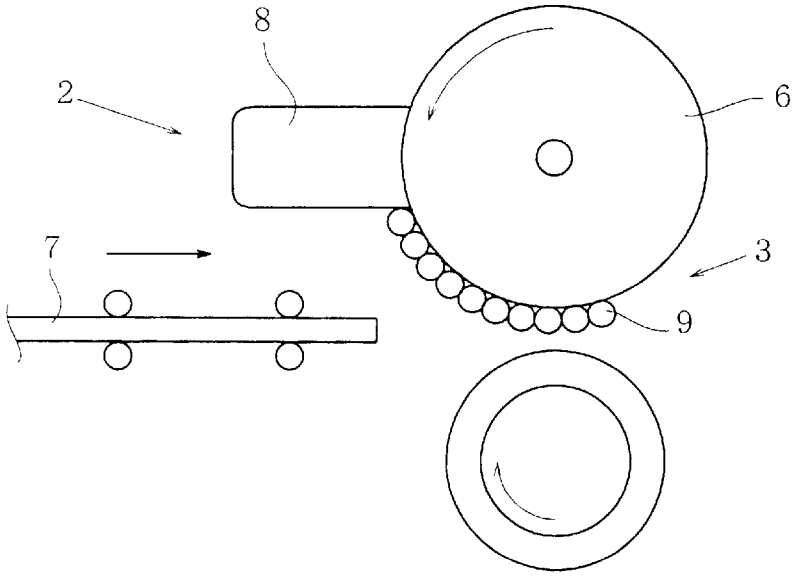
FIG.3 PRIOR ART
FIG. 3 is a schematic elevational view showing a developing section and a transfer section provided in the manufacturing device of FIG. 2.
Figure 4:
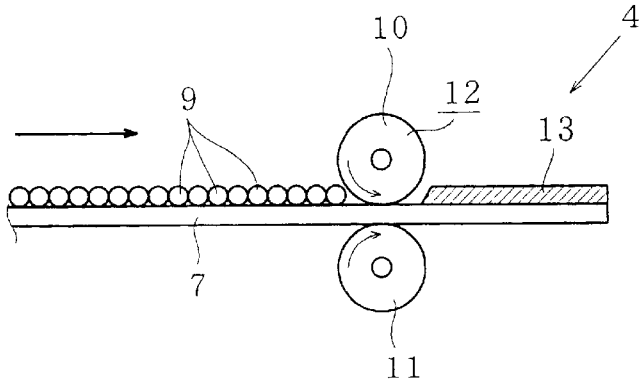
FIG.4 PRIOR ART
FIG. 4 is a schematic elevational view showing a fixing section provided in the manufacturing device of FIG. 2.
Figure 5:
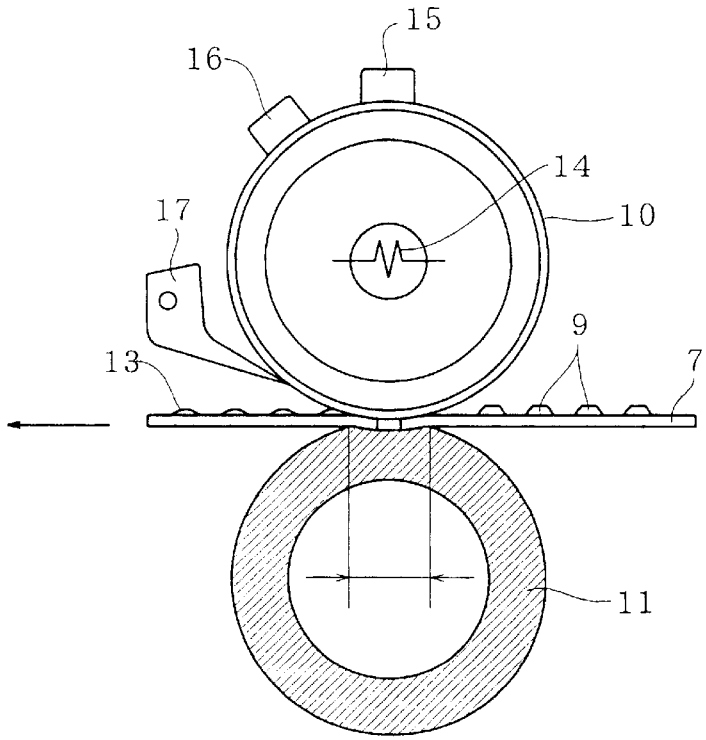
FIG.5 PRIOR ART
FIG. 5 is an enlarged diagram showing a fixing roller provided in the fixing section of FIG. 4.

An embodiment of the present invention will be described hereinafter with reference to FIG. 1, showing a main portion of a device for manufacturing paper for a thermal printer. The manufacturing device of the present invention has its main feature in a fixing section thereof, and the other sections have the same constructions as those of the conventional manufacturing device. Accordingly, the descriptions pertaining to the conventional constructions are omitted or simplified.

The manufacturing device of the present invention is provided with an application means 20 and a fixing means 24. The substrate 7 wound around a supply spool 25 is guided by a guide roller 27, and fed to the application means 20. The application means 20 applies particulate coating composite on one of the surfaces of the substrate 7. The particulate coating composite is fixed on the substrate 7 at the fixing means 24 and wound around a take-up spool 26 while being guided by a guide roller 28. Thus product paper wound on the take-up spool is supplied to a cutting device where the paper is cut into sheets of desired size and shape, and thereafter, the sheets in a predetermined number are packaged as one pack, and shipped.

The application means 20 has the same construction as that of the conventional substrate feeder section 1, coating composite supply section 2 and the coating composite apply section 3 described above, or other known conventional devices. The fixing means 24 has at least one fixing roller device 23 comprising an upper roller 21 and a lower roller 22. When the substrate 7 passes through the rollers 21 and 22, the particulate coating composite is fixed on the substrate 7. The upper roller 21, which contacts the surface of the substrate 7 on which the particulate coating composite is applied, is a hard roller, while the lower roller 22, which contacts the other surface of the substrate 7, is a soft roller.

The material for constructing the hard roller is preferably fluororesin such as perfluoroalkoxy resin (PFA) and polytetrafluoroethylene resin (PTFE). More specifically, the hard roller may be a tube of aluminum alloy coated with the PFA or PTFE on the surface thereof. The shape of the roller may be a straight, crown or inverted crown shaft or a cylinder. The thickness of the PTA or the PTFE may be in the range between 0.2 and 1.0 mm, and preferably in the range of 0.2 and 0.5 mm.

The soft roller comprises a tube of aluminum alloy on which is disposed a layer of silicone rubber. The silicon rubber layer is covered with a thin film of FRA. The thickness of the silicone rubber layer need not be specified, but preferably small, for example, in the range between 0.3 and 1.0 mm. The thickness of the PTA thin film is in the range between 0.3 and 1.0 mm, and preferably in the range of 0.3 and 0.5 mm. The thin film may not be necessarily provided. The hardness of the soft roller is in the range between 50 and 90 degrees, and preferably in the rage between 70 and 90 degrees.

A heating means is provided in the lower roller 22. The heating means may be a known heater provided in the convention devices, such as a halogen lamp. If the fixing rate is large, that is when the passing speed of the substrate 7 is high, the substrate 7 may be preheated by such means as the infrared lamp. The substrate 7 may calendered after the fixing so that the smoothness of the surface thereof is improved.

The particulate coating composite includes resin as the main component and an offset preventing agent (wax). The resin is, as described in Japanese Patent Application Laid Open 8-112974, saturated polyester resin, polyamide resin, polyacrylic ester resin, or other resins, used singularly, or as a mixture of more than one of these resins. More specifically, a saturated polyester resin marketed by Toyobo Kabushiki Kaisha under the trade name of "Vylon RV200" is preferably used.

In the present embodiment, white colorant is included in the particulate coating composite. Titanium oxide, tin oxide and others are preferably used as the white colorant. The white colorant is usually added in the range of 0.5 percent by weight and 15 percent by weight.

In the manufacturing device of the present embodiment, the heating temperature of the heating means provided in the roller 22 is set so as to be higher than the melting point (for example, the melt starting temperature of 102° C., or the melt completing temperature of 140° C.), and lower than the melting point of the offset preventing agent, for example, 150° C., that is about 145° C., for example. When the particulate coating composite includes a plurality of resins, the melting point inevitably varies. Hence the heating temperature must be determined considering the variation in the melting point.

The reason for rendering the upper roller, which contacts the surface of the substrate on which the particulate coating composite is disposed, a hard roller is explained. In order to prevent forming of blank portions at printing, the image forming layer must be thoroughly formed on one side of the substrate 7 over the entire surface thereof without any gaps. Because of the fiber arrangement in the substrate 7, it is impossible to form the surface of the substrate 7 completely even, so that the substrate has projections and recesses. If the upper roller is a hard roller as in the present embodiment, due to a concentrated load exerted on theses projections on the surface of the substrate, the white particulate coating composite on the projections is crushed and diffused. As a result, the white particulate coating composite is fixed more thoroughly over the entire surface of the substrate then when the upper roller 21 is a soft roller. Hence the image forming layer is formed on the entire surface without fail. Accordingly, the forming of blank portions at printing is prevented, thereby providing a printing of high quality.

The reason for rending the lower roller a soft roller is explained. If both of the rollers 21 and 22 are hard rollers, the area which the rollers contact is small, or narrow. Thus it is difficult to crush and diffuse the white particulate coating composite in the recesses caused by the fiber arrangement of the substrate. On the other hand, when the lower roller 22 is a soft roller, due to the elasticity of the soft roller, the contact area is increased, so that the white particulate coating composite is effectively crushed and diffused. Thus, the lower roller 22 which is disposed at the side of the substrate 7 where the particulate coating composite is not applied, is a soft roller.

The reason the heating means is provided in the lower roller 22 is as follows. In order to prevent the blank portions to be formed in an image at printing, it is necessary to thoroughly form the image forming layer on the entire surface of the substrate without gaps. Hence the fixing of the particulate coating composite to the substrate must be ensured. When the particulate coating composite is heated by a heating means from the composite applied surface, the junction of the substrate 7 and the particulate coating composite is located far from the heating means. In other words, the heat from the heating means is blocked by the particulate coating composite 9. Hence the heat quantity applied to the junction is decreased, so that the melting of the heated portion is retarded. As a result, the melting and thereafter, the fixing operations become incomplete, so that the fixing may not be ensured.

On the other hand, in the present embodiment, the heat is applied from the other side of the substrate 7. Hence the junction is located at the position where the heat from the heating means is transmitted without blocking of the particulate coating composite 9 so that the heat quantity is increased, thereby quickly melting the heated portion. Thus the fixing operation after the melting is sufficiently carried out, resulting in the sufficient fixing. Hence in the present embodiment, the particulate coating composite is heated from the opposite side of the material applying side.

The reason for setting the heating temperature higher than the melting point of the resin included in the particulate coating composite and lower than the melting point of the offset preventing agent is as follows. The offset preventing agent is used to improve the peeling characteristic of the melted coating composite from the roller 21. Namely, by diffusing the offset preventing agent over the entire surface of the substrate 7, the peeling characteristic can be enhanced. However, the surface of the melted offset preventing agent becomes smooth, and hence, such a smooth surface of the thoroughly diffused offset preventing agent reduces the transferring efficiency of colorant at recording an image on the paper by the thermal printer. Such a deterioration happens in dye melting transfer system and also in dye sublimating transfer system. Namely, in the case of the dye melting transfer system, the bonding force between the ink and the image forming layer is weakened by the thoroughly diffused offset preventing agent. In the case of the dye sublimating transfer system, sufficient diffusion of the ink is prevented by the offset preventing agent. Therefore, at the fixing of the coating composite, the heating temperature is so set to melt the resin, which is the main component of the particulate coating composite, but not to melt the offset preventing agent.

Accordingly, when the heating temperature is higher than the melting point of the resin and lower than the melting point of the offset preventing agent, the resin is sufficiently melted to be diffused over the entire surface of the substrate. Meanwhile, the offset preventing agent is not much melted and stays in the particulate form in the image forming layer. Thus the detrimental effect of the offset preventing agent can be removed.

The paper manufacturing device thus constructed is capable of manufacturing paper wherein the white particulate coating composite is crushed and diffused without fail. As a result, the white particulate composite is fixed over the entire surface of the substrate 7, thereby ensuring that the image forming layer on the entire surface thereof is formed. Hence, the blank portion is prevented from being formed at printing, thus achieving a high quality printing. Moreover, the device is constructed relatively easily, which results in the decrease of the manufacturing cost.

EXAMPLE

An experiment for testing the quality of the paper for a thermal printer manufactured using the thus described manufacturing device is described. Paper was manufactured using the manufacturing device of the present invention, namely the fixing section of the device, and the conventional manufacturing device. On each sheet of paper, an image was printed, and the formation of blank portions thereof was observed by sight. In the following table showing the result of the experiment, the symbol ◎ indicates that no blank is formed. The symbol ○ indicates that blank portions hardly noticed by sight are formed. The symbol Δ indicates that blank portions noticed by sight are formed, and the symbol × indicates that the significant blank portions are formed.

The composition of the white particulate coating composite used in the experiment is as follows. Namely, the percentages were 73 percent by weight of saturated polyester resin, 15 percent by weight of styrene acrylic copolymer, 4 percent by weight of offset preventing agent, 2 percent by weight of antistatic agent, 5 weight percent of white pigment, and 1 percent by weight of epoxy denatured silicone oil. When forming the image forming layer, each component of the white particulate coating composite was melted and kneaded, and then ground, thereby to form the particulate composite wherein the average diameter of the particles was about 10 $\mu$m. Hydrophobic silica in the quantity of 0.5 parts by weight was added to the white particulate coating composite of 100 parts by weight. In addition, a carrier, namely, iron powder was added so that the white particulate composite became 8.4 percent by weight, thereby preparing a developer. As the substrate, a commercially sold paper for thermal printer having a weight of 105 g/m$^2$ was used.

Such a conventional device as an electrostatic powder application device was used as the application means. The applying conditions were as set below. The developing bias was −200 V, voltage applied to the charged drum was 4.0 to −4.8 kV, the transfer potential was −5.5 V, the circumferential velocity of the developing sleeve was 60 mm/sec, and the the circumferential velocity speed of the charged drum was 20 mm/sec.

The upper roller of the fixing roller device provided in the manufacturing device of the present invention had a straight shape, and an aluminum tube as the core, coated with PFA. The thickness of the PFA coating was 500 $\mu$m, and the outer diameter 40 mm. The lower roller had an straight aluminum tube as the core, inner coating of silicone rubber, and the outer coating of PFA. The thickness of the outer coating was 500 $\mu$m, and the thickness of the inner coating was 0.5 mm. The outer diameter of the roller was 40 mm. The heating means provided in the lower roller was a halogen lamp which heated the particulate coating composite at the temperature of 150° C. The substrate was horizontally discharged from the fixing roller device.

The result of the experiment is set in the following table.

TABLE

| | Upper Roller (Applying Side Roller) | | | | Lower Roller (Non-applying Side Roller) | | | | |
|---|---|---|---|---|---|---|---|---|---|
| | Material | Thickness | Outer Diameter | Heating | Material | Thickness | Outer Diameter | Heating | Valuation |
| Present Invention | PFA | 0.6 mm | 45 mm | OFF | Outer Coating: PFA<br>Inner Coating: Silicone Rubber | 0.6 mm<br>0.6 mm | 45 mm<br>45 mm | 145°<br>145° | ⊙ |
| Comparative Example 1 | PFA | 0.6 mm | 45 mm | 125° | Outer Coating: PFA<br>Inner Coating: Silicone Rubber | 0.6 mm<br>0.6 mm | 45 mm<br>45 mm | OFF<br>OFF | ○ |
| Comparative Example 2 | PFA | 0.6 mm | 45 mm | OFF | Outer Coating: PFA<br>Inner Coating Silicone Rubber | 0.6 mm<br>0.6 mm | 45 mm<br>45 mm | 160°<br>160° | Δ |
| Comparative Example 3 | PFA | 0.6 mm | 45 mm | OFF | PFA | 0.6 mm | 45 mm | 145° | ○ |
| Comparative Example 4 | Outer Coating: PFA<br>Inner Coating: Silicone Rubber | 0.6 mm<br>0.6 mm | 45 mm<br>45 mm | OFF<br>OFF | Outer Coating: PFA<br>Inner Coating: Silicone Rubber | 0.6 mm<br>0.6 mm | 45 mm<br>45 mm | 145°<br>145° | Δ |
| Comparative Example 5 | Outer Coating: PFA<br>Inner Coating: Silicone Rubber | 0.6 mm<br>0.6 mm | 45 mm<br>45 mm | OFF<br>OFF | PFA | 0.6 mm | 45 mm | 145° | X |

As can be seen from the table, the paper of the present invention was of excellent quality, causing no blank portions at all, and resulting in a satisfactory transfer of the image. More particularly, comparing the paper of the present invention with the comparative example 1, the paper of the present invention had better fixing characteristic, thereby decreasing the formation of blank portions. When compared with the comparative example 2, it can be understood that the ill effect of the offset preventing agent was removed, thereby decreasing the formation of the blank portions. When compared with the comparative examples 4, 5 and 6, advantages of providing the hard upper roller can be seen.

In accordance with the device and the method of the present invention, there is manufactured paper for a thermal printer wherein the image forming layer can be formed on the substrate without fail, and the detrimental ill effect of the offset preventing agent is removed. Hence, ink can be sufficiently spread on the paper when printing an image on the paper.

While the invention has been described in conjunction with preferred specific embodiment thereof, it will be understood that this description is intended to illustrate and not limit the scope of the invention, which is defined by the following claims.

What is claimed is:

1. A device for manufacturing paper for a thermal printer comprising:

coating means for coating particles of a particulate coating on a first side of a paper substrate, said coating particles consisting of particles of resin and particles of an offset preventing agent having a higher melting point than that of said resin; and fixing means positioned proximate said coating means for receiving and fixing said paper substrate having said particulate coating deposited thereon, said fixing means including a first roller having a hard outer surface positioned immediate said first side of said paper substrate, and a second roller having a soft outer surface opposing said first roller and receiving said paper substrate between said first and second rollers, said second roller including means therein for heating said paper substrate and said coating from the second side thereof to a temperature which is higher than the melting point of said resin and lower than a melting point of said offset preventing agent, said temperature being set by a means for setting the temperature of said means for heating.

2. The device according to claim 1 wherein one of the first and second rollers which is to be contacted with the particulate coating is made of material having a hardness higher than that of the other roller.

3. The device according to claim 1 wherein the means for heating is provided in the second roller which is disposed on a side of the paper substrate on which the particulate coating is not coated.

* * * * *